United States Patent [19]

Atkins

[11] Patent Number: 4,781,330

[45] Date of Patent: Nov. 1, 1988

[54] CONNECTOR HOOD

[75] Inventor: Jack F. Atkins, Garland, Tex.

[73] Assignee: Custom Computer Cables, Inc., Plano, Tex.

[21] Appl. No.: 905,292

[22] Filed: Sep. 9, 1986

[51] Int. Cl.[4] ..... H01R 13/627

[52] U.S. Cl. ..... 439/359; 439/361; 439/460

[58] Field of Search ..... 339/92, 103, 104, 106, 339/107, 59–63, 125 R, 263 R, 272 R, 272 A, 126 R, 91 R, 101, 122, 196 M, 206 R, 206 P, 208; 411/531–535

[56] References Cited

U.S. PATENT DOCUMENTS

| | | | |
|---|---|---|---|
| 3,124,408 | 3/1964 | Oestereicher | 339/263 R |
| 3,170,749 | 2/1965 | Johanson et al. | 339/107 |
| 3,218,906 | 11/1965 | Dupree | 411/533 |
| 3,885,852 | 5/1975 | Grove | 339/122 R |
| 3,904,265 | 9/1975 | Hollyday et al. | 339/103 M |
| 4,130,329 | 12/1978 | Chandler et al. | 339/103 M |
| 4,421,376 | 12/1983 | Cosmos et al. | 339/103 M |
| 4,549,786 | 10/1985 | Bertini et al. | 339/107 |

FOREIGN PATENT DOCUMENTS

| | | | |
|---|---|---|---|
| 1170326 | 7/1984 | Canada | 339/103 R |

OTHER PUBLICATIONS

"Scanbe's New Card File Components System Here's How", pp.: 3, 5, 17–19.

*Primary Examiner*—David L. Pirlot
*Attorney, Agent, or Firm*—Harry C. Post, III

[57] ABSTRACT

A device preventing connector pins attached to individual wires in a conductor from becoming removed from a computer connector. The device includes a body, which defines a chamber and includes a top, a bottom and sides joining the top and bottom. The computer connector is secured to the bottom of the body by a connecting apparatus and the conductor is secured to the body by a strain relief mechanism. The device prevents the connector pins from becoming removed from the computer connector when moving the conductor after the strain relief member has secured the conductor to the body and the connecting apparatus has secured the computer connector to the body.

18 Claims, 2 Drawing Sheets

CONNECTOR HOOD

Devices to prevent connector pins attached to individual wires in a conductor from becoming removed from a computer connector are well known and are commonly called connector hoods.

The prior art connector hood typically has a body defining a substantially hollow interior. The wires in the conductor are individually attached to the pins in the connector and the conductor passes through an opening either in the top or side of the body. The conductor is secured to the body by use of a strain relief member, which embodies a series of teeth for engaging with rows of teeth on the body. The teeth compliment each other so as to provide a ratchet arrangement to secure the conductor to the top of the body. The connector is secured to the body after the device has been attached to the computer. Generally the prior art hood is constructed from two halves, which are connected to one another by a screw and nut arrangement. Typically, this arrangement involves a screw extending through aligned passageways provided in each half and threadedly connected to a nut, which may be inset in the respective half.

Although these prior art connector hoods function well to prevent the individual wires in a conductor from becoming removed from a computer connector, in certain situations the prior art hoods are not as effective as a user might desire. For instance, when a computer is being backed up against an obstruction, such as a wall, sufficient space must be provided to allow the conductor to be bent after passing through the opening in the top or a different prior art device is required to be purchased having an opening in the side. The present invention has an opening in the top and may be adapted to provide an opening in the side such that the conductor may pass through either opening.

Further, the design of the prior connector hoods have a weakness that may cause them to fail from preventing the individual wires in a conductor from becoming removed from a computer connector. That is, the series of teeth in the body and strain relief member of the prior art devices extend from a base into a tip or sharp point. Through wear, the tips of the teeth in the body of the hood will break. Once broken they may become dislodged and work into the teeth on the strain relief member or the body to prevent the ratchet arrangement from securing the conductor to the hood. The present invention is adapted to inhibit the breaking of the tip from each of the series of teeth in the body of the device.

Further, attaching the prior art connector hoods to the computer connector and conductor requires the user to have a substantial amount of manual dexterity because of the complexity of its design. The present invention is adapted to be made from first and second body halves, which will support the connector on the body of the device when the body halves are connected to one another so as to eliminate the manual dexterity requirements of the prior art devices.

In accordance with the present invention, a device is used to prevent connector pins attached to individual wires in a conductor from becoming removed from a computer connector. A body is used in the device to define a chamber and includes a top, a bottom and first, second, third and fourth sides joining the top and bottom. An opening is defined in the top and has sufficient size to allow the conductor passage into the chamber. The bottom is open to receive the computer connector. A connecting apparatus is provided on the body to secure the computer connector to the bottom of the body. A removably connected portion is provided in the first side of the body and is of a size sufficient to allow the conductor passage into the interior of the body. A strain relief member is used to secure the conductor to the body. A first supporting arrangement is provided on the body to support the strain relief member in close proximity to the opening in the top of the body. A second supporting arrangement is provided on the body to support the strain relief member in close proximity to the removably connected portion in the side. The connector pins are prevented from becoming removed from the computer connector when moving the conductor after the strain relief member has secured the conductor to the body and the connecting apparatus has secured the computer connector to said body.

Further, in accordance with the present invention a device is used to prevent connector pins attached to individual wires in a conductor from becoming removed from a computer connector. A body is provided in the device to define a chamber and has a top, a bottom and sides joining the top and bottom. The bottom is open to receive the computer connector and the top defines an opening of sufficient size to allow the conductor passage into the chamber. A connecting apparatus is provided on the body to secure the computer connector to the bottom of the body. A first row of teeth is provided on the body in close proximity with a junction of the top and one side and a second row of teeth is provided on the body in a facing relationship with the first row of teeth and disposed in close proximity with a junction of the top and another side. Each tooth in the first and second rows has a generally flat shoulder extending in a direction toward the facing row of teeth and a generally planar surface extending in a transverse direction relative to the flat shoulder. A strain relief member is used to secure the conductor to the body and includes a generally U-shaped member having a base and two arms connected to and extending away from the base. The two arms are displaced from one another by a distance sufficient to receive the conductor. A series of triangularly shaped teeth are disposed along each arm in a direction facing away from the other arm. Each tooth in the series has a tapering shoulder to deflect the arms toward one another when the strain relief member is moved along the rows of teeth in the body and a substantially flat shoulder to complimentarily engage a substantially flat shoulder on a tooth of the first and second rows of teeth to prevent movement of said strain relief member in a direction toward the substantially flat shoulder. A supporting arrangement supports the strain relief member in close proximity with the opening in the top of the body. The connector pins are prevented from becoming removed from the computer connector when moving the conductor after the strain relief member has secured the conductor to the body and the connecting apparatus has secured the computer connector to said body.

Further, in accordance with the present invention, a device is used to prevent connector pins attached to individual wires in a conductor from becoming removed from a computer connector. A body is provided to define a chamber and includes a top, a bottom and sides joining the top and bottom. The top defines an opening of sufficient size to allow the conductor passage into the chamber and the bottom is open to receive the computer connector. A strain relief member is used to secure the conductor to the body. A supporting arrangement is provided on the body to support the strain relief member in close proximity to the opening in the top. A connecting apparatus is provided on the body to secure the computer connector to the bottom of the body and includes first and second connecting members. The first connecting member is provided at the bottom of the body and extends along one of the sides and the second connecting member is provided at the bottom of the body and extends along a side opposed to the side from which the first connecting member extends. The first and second connecting members have a lip portion and a connecting portion. The lip portion of one connecting member extending toward the lip portion on the opposed connecting member. The connecting portion has a length sufficient to receive a shoulder on the computer connector between the lip portion and bottom. The connector pins are prevented from becoming removed from the computer connector when moving the conductor after the strain relief member has secured the conductor to the body and the connecting apparatus has secured the computer connector to said body.

Further, in accordance with the present invention a device is used to prevent connector pins attached to individual wires in a conductor from becoming removed from a computer connector. A body is adapted to define a chamber and includes first and second body halves with the halves being mirror images of one another. Each half has a substantially planar side wall, facing side walls joined to and extending along opposite sides of and transversely to the planar wall and a connecting wall interconnecting the facing side walls joined to and extending along a side of and transversely to the planar wall. An opening is provided in the connecting side wall. A body half connecting apparatus is provided to connect the first and second halves of the body to one another. When the first and second body halves are connected to one another the substantially planar side walls form second and fourth sides, the facing side walls form first and third sides, the connecting walls form a top with the opening in each body half allowing the conductor access into the chamber and a bottom being open to receive the computer connector. A computer connector connecting apparatus is provided on the body for securing the computer connector to the bottom of the body. A strain relief member is used to secure the conductor to the body. The connector pins are prevented from becoming removed from the computer connector when moving the conductor after the strain relief member has secured the conductor to the body and the connecting apparatus has secured the computer connector to said body.

Other objects and advantages of the invention will become apparent upon reading the following detailed description and upon reference to the drawings, wherein like reference characters are used throughout to designate like parts:

Figure 2:
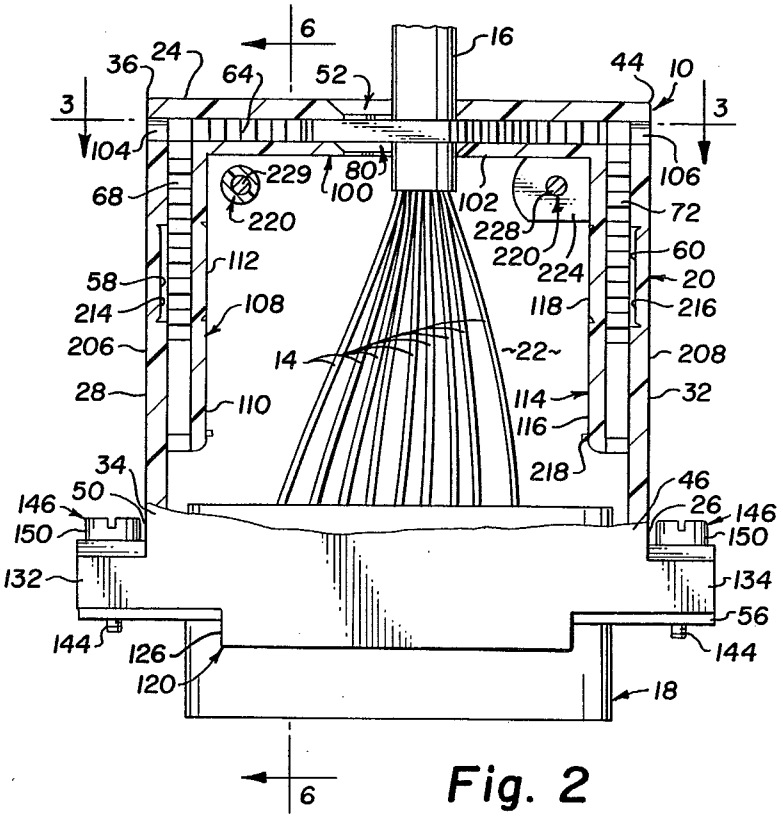
FIG. 2 is a side elevational view taken along lines 2—2 in the direction of the arrows of the device shown in FIG. 1.
Figure 1:
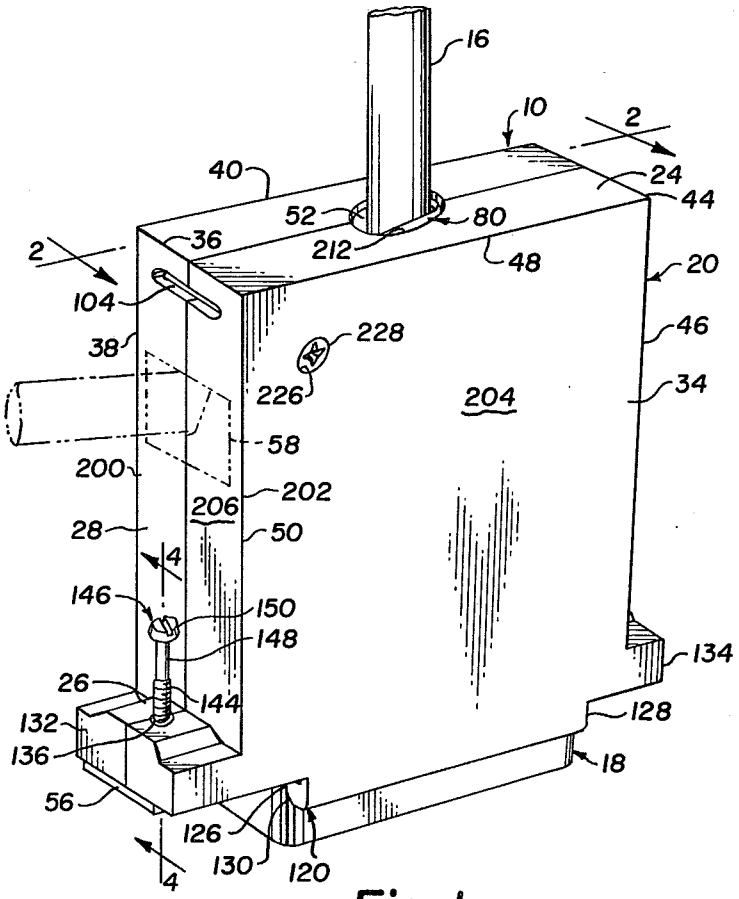
FIG. 1 is a perspective view of a device to prevent connector pins attached to individual wires in a conductor from becoming removed from a computer connector constructed in accordance with the present invention.
Figure 6:
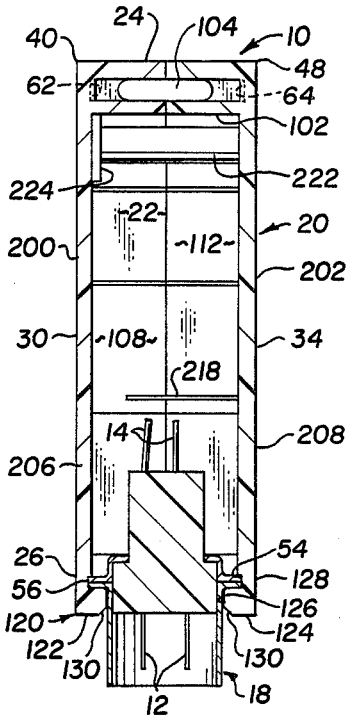
FIG. 6 is a side elevational view taken along line 6—6 in the direction of the arrows of the device shown in FIG. 1
Figure 4:
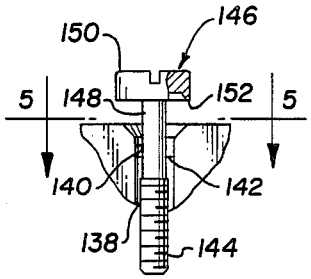
FIG. 4 is an enlarged elevational view taken along a portion of lines 4—4 in the direction of the arrows of a portion of the device shown in FIG. 1.
Figure 5:
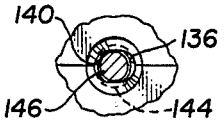
FIG. 5 is a planar view taken along lines 5—5 in the direction of the arrows of a portion of the device shown in FIG. 4.

Turning now to FIGS. 1, 2 and 6 of the drawings, there is shown a device 10 preventing connector pins 12 attached to individual wires 14 in a conductor 16 from becoming removed from a computer connector 18. Conductor 16 and computer connector 18 are of conventional design with the number of individual wires 14 being dependent on the number of connector pins 12 provided on computer connector 18. Preferably, device 10 is designed and used with a subminiature "D" series computer connector 18.

A body 20 defining a chamber 22 to receive a portion of conductor 16 is included in device 10 and includes a top 24, a bottom 26, a first side 28, a second side 30, a third side 32 and a fourth side 34. First side 28 is connected to top 24 at junction 36 and to second side 30 at junction 38. Second side 30 is connected to top 24 at junction 40 and to third side 32 at junction 42. Third side 32 is connected to top 24 at junction 44 and to fourth side 40 at junction 46. Fourth side 40 is connected to top 24 at junction 48 and to first side 28 at junction 50. An opening 52 is defined in top 24 and has a size sufficient to allow conductor 16 passage into chamber 22. Bottom 26 is open to receive computer connector 18 and a channel 54 is formed in sides 28, 32, 36 and 40 to receive a shoulder 56 provided on the conventional computer connector 18.

A first removably connected portion 58 is provided in first side 28 of body 20 and is of a size sufficient to allow conductor 16 passage into chamber 22 of body 20. A second removably connected portion 60 is provided in second side 30 of body 20 and is of a size sufficient to allow conductor 16 passage into chamber 22 of body 20. Both first and second removably connected portions are weakened knock out portions formed in its respective side by a conventional process, such as by forming when the body is being molded or by milling or similar machining after the body has been made.

Figure 3:
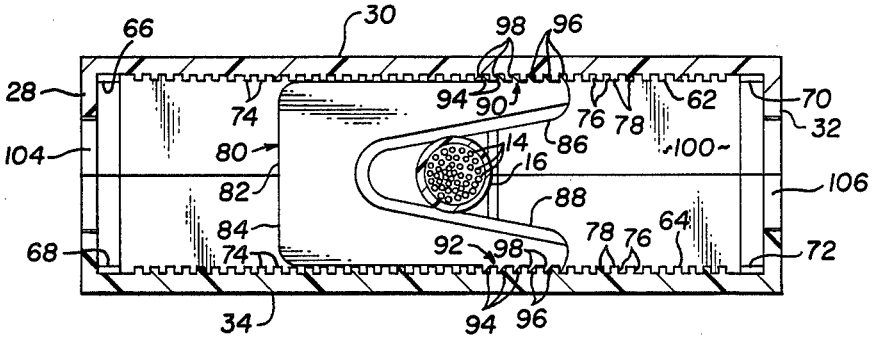
FIG. 3 is an enlarged planar view taken along lines 3—3 in the direction of the arrows of a portion of the device shown in FIG. 2.

As best seen in FIGS. 2, 3 and 6, a first row of teeth 62 are provided on body 20 to extend from second side wall 30 from a point in close proximity with junction 40. A second row of teeth 64 are provided on body 20 to extend from fourth side wall 34 from a point in close proximity with junction 48. A third row of teeth 66 are provided on body 20 to extend from second side wall 30 from a point in close proximity with junction 38. A fourth row of teeth 68 are provided on body 20 to extend from fourth side wall 34 from a point in close proximity with junction 50. A fifth row of teeth 70 are provided on body 20 to extend from second side wall 30 from a point in close proximity with junction 42. A sixth row of teeth 72 are provided on body 20 to extend from fourth side wall 34 from a point in close proximity with junction 46. First row of teeth 62, third row of teeth 66 and fifth row of teeth 70 are disposed in a facing relationship with second row of teeth 64, fourth row of teeth 68 and sixth row of teeth 72, respectively. Each tooth 74 in rows of teeth 62, 64, 66, 68, 70 and 72 has a generally flat shoulder 76 extending in a direction toward the respective facing row of teeth and a generally planar surface 78 extending in a transverse direction relative to flat shoulder 76.

As best seen in FIGS. 1, 2 and 3, a strain relief apparatus 80 is used to secure conductor 16 to body 20. Strain relief apparatus 80 includes a relatively thin and generally U-shaped member 82, which has a base 84, an arm 86 connected to an end of base 84 and an arm 88 connected to the other end of base 84. Arms 86 and 88 are disposed to extend in the same direction away from base 84 and are displaced from one another by a distance sufficient to receive conductor 16 at a location between the outboard ends and base 84. A first series of teeth 90 is disposed along arm 86 and a second series of teeth 92 is disposed along arm 88, such that the series of teeth 90 and 92 are disposed to face in a direction looking away from the arm on which the other series of teeth is provided. Each tooth 94 in series 90 and 92 has a tapering shoulder 96 to deflect arms 86 and 88 toward one another when strain relief apparatus 80 is moved along rows of teeth 62 and 64, 66 and 68, or 70 and 72 in body 20. A substantially flat shoulder 98 is provided on each tooth 96 for complimentarily engaging generally flat shoulder 76 on each tooth 74 of rows of teeth 62, 64, 66, 68, 70 and 72 to prevent movement of strain relief apparatus 80 in a director toward the generally flat shoulder 76 on body 20.

As best seen in FIGS. 2, 3 and 6, strain relief apparatus 80 may be supported in close proximity to opening 52 in top 24 of body 20 by a first supporting arrangement 100, which includes a first support wall 102. First support wall 102 is connected to second side 30 and fourth side 34 at a location interiorly of and in close proximity to first and second rows of teeth 62 and 64, respectively. To inhibit the possibility of strain relief apparatus 80 from becoming stuck within the channel formed between top 24 and wall 102, wall 102 is substantially flat so as to lie in a plane, which lies substantially parallel to a plane formed by top 24, and is displaced from top 24 by a distance just adequate to permit strain relief apparatus 80 to move between top 24 and wall 102 without binding interference. A first aperture 104 is provided through first side wall 28 between top 24 and support wall 102 and a second aperture 106 is provided through third side wall 32 between top 24 and support wall 102. First aperture 104 and second aperture 106 permit access of a probe through the side walls to act against base 84 of strain relief apparatus 80 when securing conductor 16 to top 24 of body 20.

Strain relief apparatus 80 may also be supported in close proximity to first removably connected portion 58 in first side wall 28 of body 20 by a second supporting arrangement 108, which includes a second support wall 110. Second support wall 110 is connected to second side 30 and fourth side 34 at a location interiorly of and in close proximity to third and fourth rows of teeth 66 and 68, respectively. Second support wall 110 is generally L-shaped with the end of the upper extension of the "L" being connected to one end of first support wall 102 and the end of the lower extension of the "L" being connected to first side wall 28 at a location below the ends of third and fourth rows of teeth 66 and 68, respectively. To inhibit the possibility of strain relief apparatus 80 from becoming stuck within the channel formed between side wall 28 and second support wall 110, wall 110 is substantially flat so as to lie in a plane, which lies substantially parallel to a plane formed by first side wall 28, and is displaced from side wall 28 by a distance just adequate to permit strain relief apparatus 80 to move between first side wall 28 and support wall 110 without binding interference. Second support wall 110 also includes a removably connected portion 112 generally aligned with the first removably connected portion 58 in first side 28 and of a size sufficient to allow conductor 16 passage into chamber 22. Removably connected portion 112 is a weakened knock out portion formed in the second support wall 110 by a conventional process, such as by forming when the body is being molded or by milling or similar machining operation after the body has been made.

Strain relief apparatus 80 may also be supported in close proximity to second removably connected portion 60 in third side wall 32 of body 20 by a third supporting arrangement 114, which includes a third support wall 116. Third support wall 116 is connected to second side 30 and fourth side 34 at a location interiorly of and in close proximity to fifth and sixth rows of teeth 70 and 72, respectively. Third support wall 116 is generally L-shaped with the end of the upper extension of the "L" being connected to the end of first support wall 102 opposite to the end to which second support wall 110 is connected and the end of the lower extension of the "L" being connected to third side wall 32 at a location below the ends of fifth and sixth rows of teeth 70 and 72, respectively. To inhibit the possibility of strain relief apparatus 80 from becoming stuck within the channel formed between third side wall 32 and third support wall 116, wall 116 is substantially flat so as to lie in a plane, which lies substantially parallel to a plane formed by third side wall 32, and is displaced from side wall 32 by a distance just adequate to permit strain relief apparatus 80 to move between side wall 32 and support wall 116 without binding interference. Third support wall 116 also includes a removably connected portion 118 generally aligned with the second removably connected portion 60 in third side 32 and of a size sufficient to allow conductor 16 passage into chamber 22. Removably connected portion 118 is a weakened knock out portion formed in the third support wall 116 by a conventional process, such as by forming when the body is being molded or by milling or similar machining operation after the body has been made.

As best seen in FIGS. 1, 2 and 6, a connecting apparatus 120 is provided on body 20 to secure computer connector 18 to bottom 26 of body 20 and includes first and second connecting members 122 and 124, respectively. First connecting member 122 extends from bottom 26 of body 20 in a direction away from top 24 and along second side wall 30, while second connecting member 124 extends bottom 26 of body 20 in a direction away from top 24 and along fourth side wall 34. First and second connecting members 122 and 124, respectively, have a lip portion 126 and a connecting portion 128. The lip portion of one connecting member either 122 or 124 extends toward the lip portion on the opposed connecting member, either 124 or 122, respectively. The connecting portion of connecting members 122 and 124 is partially formed by channel 54, which has a length sufficient to receive shoulder 56 on computer connector 18 between lip portion 126 and bottom 26. A beveled surface 130 is provided on first and second connecting members 122 and 124, respectively, to face away from the interior of said body on the outboard or free end of lip portion 126 so as to facilitate movement of computer connector 18 between first and second connecting members 122 and 124, respectively.

As best seen in FIGS. 1, 2, 4 and 5, a first shoulder 132 is provided on body 20 to extend away from the interior of body 20 outwardly of first side 28 and a second shoulder 134 is provided on body 20 to extend away from the interior of body 20 outwardly of third side 32. Extending through first and second shoulders 132 and 134, respectively, is a passageway 136, which runs in a direction generally parallel to a plane formed by sides 28 and 32 and from top 24 to bottom 26. Each passageway 136 has a portion 138 with a circular cross-section facing toward bottom 26 of body 20, a portion 140 with an oval cross-section facing toward top 24 and a constriction 142 to provide an abuttment for threads 144 on a screw 146 used in attaching body 20 to a computer (not shown). Constriction 142 is provided at the junction of circular cross-section portion 136 and oval cross-section portion 138 by providing the major axis of oval portion 138 with the same dimension as the diameter of circular cross-section portion 138.

Screw 146 is of conventional design having threads 144, an inwardly disposed shank 148 and an outwardly disposed head 150, except that head 150 includes an annular lip portion 152 extending in the direction of shank 148.

Preferably, body 20 is made from molded plastic and has a first body half 200 and a second body half 202 with the body halves being mirror images of one another. Each body half 200 and 202 includes a substantially planar side wall 204; first and second facing side walls 206 and 208, respectively, joined to and extending along opposite sides of and transversely to planar wall 204; and a connecting wall 210 interconnecting facing side walls 206 and 208 and joined to and extending along a side of and transversely to planar wall 204. A semicircular opening 212 is molded in connecting side wall 210 of each body half to provide opening in body 20. A first weakened portion 214 is molded in facing side wall 206 and a second weakened portion 216 is molded in facing side wall 208 to provide first and second removably connected portion 58 and 60, respectively, in body 20. A first single set of teeth is molded in the form previously described along the interior of planar wall 204 in close proximity with connecting wall 210 to provide first and second rows of teeth 64 and 64, respectively, in body 20. A second single set of teeth is molded in the form previously describe along the interior of planar wall 204 in close proximity with facing side wall 206 to provide third and fourth rows of teeth 66 and 68, respectively, in body 20. A third single set of teeth in molded in the form previously described along the interior of planar wall 204 in close proximity with facing side wall 208 to provide fifth and sixth rows of teeth 70 and 72, respectively, in body 20. First supporting arrangement 100, second supporting arrangement 108 and third supporting arrangement 114 in body 20 are provided by molding support first support wall 102, second support wall 110 and third support wall 116 in the forms previously described along the interior of planar wall 204. A guide pin 218 for aligning body halves 200 and 202 when connecting the body halves to one another is molded in each body half 200 and 202 to extend outwardly from planar side wall 204 in close proximity to the junction of the extensions of the "L" formed in third support wall 116 past the edge of third support wall 116 of body 20.

Body half connecting apparatus 220 is used to connect first body half 200 to second half 202 to make body 20. When first and second body halves 200 and 202, respectively, are connected to one another; substantially planar side walls 204 form second and fourth sides 30 and 34, respectively, of body 20; facing side walls 206 abutt against each other to form first side 28 of body 20; facing side walls 208 abutt against each other to form third side 32 of body 20; and connecting walls 210 abutt against each other to form top 24 of body 20. Molded in each body half 202 and 204 is a tubular extension 222 extending interiorly from a shoulder 224 on planar side wall 204 in close proximity where first support wall 102 joins with third support wall 116 and a passageway 226 extending through planar side wall 204 at a location in close proximity where first support wall 102 joins with second support wall 110. The opening extending along tubular extension 222 is generally aligned with the passageway 226 so as to receive a self-taping screw 228, which includes a head acting against a shoulder provided in passageway 226 and urge first body half 200 against second body half 202 when screw 228 is screwed into tubular extension 220.

To assemble device 10, strain relief apparatus 80 is placed over the insulation on conductor 16. If the user desires running conductor 16 through top 24, then conductor 16 is directed through opening 52 and strain relief apparatus 80 is disposed within the passage formed between top 24 and first support wall 102 in first body half 200 and second body half 202. If the user desires running conductor 16 through first side 28, then first removably connected portion 58 in first side 28 and removably connected portion 112 in second support wall 110 are removed, such as by use of pliers (not shown), and strain relief apparatus 80 is disposed within the passage formed between first side wall 28 and second support wall 110 in first body half 200 and second body half 202. If the user desires running conductor 16 through third side 32, then second removably connected portion 60 in third side 32 and removably connected portion 118 in third support wall 116 are removed, such as by use of pliers (not shown), and strain relief apparatus 80 is disposed within the passage formed between third side wall 32 and third support wall 116 in first body half 200 and second body half 202. Should tension in strain relief apparatus 80 require adjustment, it may be done by using a thin screw driver or similar device (not shown) to pass through either opening 104 or 106 or through the opening in bottom 26 of body 20. After the tension has been adjusted, if necessary, body halves 200 and 202 are held together at top 24. One side of shoulder 56 of computer connector 18 is placed in channel 54 of first connecting member 122 and the opposed side of shoulder 56 is rotated toward channel 54 of second connecting member 124 with beveled surface 130 assisting in directing the second side of shoulder 56 past lip portion 126 into channel 54. Once computer connector 18 is connected to body 20, self-tapping screws 228 are positioned within passageway 226 and screwed into tubular extension 222. A screw 146 is inserted into passageway 136 in first shoulder 132 and passageway 136 in second shoulder 134, the insertion being facilitated by the bevel in the upper portion of passageway 136. Screws 146 are then attached to a computer (not shown) to secure connector 18 thereto, which draws lip portion 152 into embedded engagement with first body half 200 and second body half 202 at shoulders 132 and 134 and thereby aid in securing the body halves to one another.

The invention having been described, what is claimed is:

1. A device to prevent connector pins attached to individual wires in a conductor from becoming removed from a computer connector, comprising: a body defining a chamber and including a top, a bottom and first, second, third and fourth sides joining the top and bottom, the top defining an opening of sufficient size to allow the conductor passage into the chamber, the bottom being open to receive the computer connector; connecting means provided on said body for securing the computer connector to the bottom of said body; a removably connected portion provided in the first side of said body, said removably connected portion being of a size sufficient to allow the conductor passage into the interior of said body; strain relief means for securing the conductor to said body; first supporting means provided on said body for supporting said strain relief means in close proximity to the opening in the top of said body; second supporting means provided on said body for supporting said strain relief means in close proximity to said removably connected portion in the first side, the connector pins being prevented from becoming removed from the computer connector when moving the conductor after said strain relief means has secured the conductor to said body and said connecting means has secured the computer connector to said body; a first row of teeth provided on said body extending from the second side in close proximity with a junction of the second side and top; a second row of teeth provided on said body extending from the fourth side in a facing relationship with the first row of teeth across the opening and disposed in close proximity with a junction of the fourth side and top; a third row of teeth provided on said body extending from the second side in close proximity with a junction of the first and second sides; a fourth row of teeth provided on said body extending from the fourth side in a facing relationship with the third row of teeth across said removably connected portion and disposed in close proximity with a junction of the first and fourth sides; and said strain relief means including a generally U-shaped member having a base and two arms connected to and extending away from the base, the two arms being displaced from one another by a distance sufficient to receive the conductor, a series of teeth disposed along each arm and facing in a direction away from the other arm; said first supporting means including a support wall connected to the second and fourth sides at a location interiorly of and in close proximity to said first and second rows of teeth; and said second supporting means including a support wall connected to the second and fourth sides at a location interiorly of and in close proximity to said third and fourth rows of teeth; a second removably connected portion provided in the third side of said body, said second removably connected portion being of a size sufficient to allow the conductor passage into the interior of said body; a fifth row of teeth provided on said body extending from the second side in close proximity with a junction of the second and third sides; a sixth row of teeth provided on said body extending from the fourth side in a facing relationship with the fifth row of teeth across said second removably connected portion and disposed in close proximity with a junction of the third and fourth sides; and a third support means for supporting the strain relief means in close proximity with said second removably connected portion provided in the third side of said body, said third support means including a wall connected to the second and fourth sides at a location interiorly of and in close proximity to said fifth and sixth rows of teeth.

2. A device as set forth in claim 1, further comprising: said connecting means including a first connecting member provided at the bottom of said body and extending along the second side, a second connecting member provided at the bottom of said body and extending along the fourth side, the first and second connecting members having a lip portion and a connecting portion, the lip portion of one connecting member extending toward the lip portion on the opposed connecting member, the connecting portion having a length sufficient to receive a shoulder on the computer connector between the lip portion and the bottom of said body.

3. A device as set forth in claim 1, further comprising: a first and second shoulder provided on said body extending away from the interior of said body outwardly of the first and second sides, respectively; a passageway extending through said first and second shoulders in a direction running generally from the top to bottom of said body, the passageway having a portion with a circular cross-section facing toward the bottom of said body and constriction provided at the end of the circular cross-section portion nearer the top of said body to provide an abuttment for threads on a screw used in attaching said body to a computer.

4. A device to prevent connector pins attached to individual wires in a conductor from becoming removed from a computer connector, comprising: a body defining a chamber and including a top, a bottom and sides joining the top and bottom, the bottom being open to receive the computer connector, the top defining an opening of sufficient size to allow the conductor passage into the chamber; connecting means provided on said body for securing the computer connector to the bottom of said body; a first row of teeth provided on said body in close proximity with a junction of the top and one side; a second row of teeth provided on said body in a facing relationship with the first row of teeth and disposed in close proximity with a junction of the top and another side, each tooth in the first and second rows having a generally flat shoulder extending in a direction toward the facing row of teeth and a generally planar surface extending in a transverse direction relative to the flat shoulder; a strain relief means for securing the conductor to said body, said strain relief means including a generally U-shaped member having a base and two arms connected to and extending away from the base, the two arms being displaced from one another by a distance sufficient to receive the conductor, a series of triangularly shaped teeth disposed along each arm in a direction facing away from the other arm, each tooth in the series having a tapering shoulder to deflect the arms toward one another when said strain relief member is moved along the rows of teeth in said body and a substantially flat shoulder to complimentarily engage a substantially flat shoulder on a tooth of the first and second rows of teeth to prevent movement of said strain relief member in a direction toward the substantially flat shoulder; and supporting means for supporting said strain relief means in close proximity with the opening in the top of said body, the computer pins being prevented from becoming removed from the computer connector when moving the conductor after said strain relief means has secured the conductor to said body and said connecting means has secured the computer connector to said body; said body including first, second, third and fourth sides; said first row of teeth extending from the second side in close proximity with a junction of the second side and top; said second row of teeth extending from the fourth side in a facing relationship with the first row of teeth across the opening and disposed in close proximity with a junction of the fourth side and top; a removably connected portion provided in the first side of said body, the portion being of a size sufficient to allow the conductor passage into the interior of said body; a third row of teeth provided on said body extending from the second side in close proximity with a junction of the first and second sides; a fourth row of teeth provided on said body extending from the fourth side in a facing relationship with the third row of teeth across said removably connected portion and disposed in close proximity with a junction of the first and fourth sides, each tooth in the third and fourth rows of teeth having a generally flat shoulder extending in a direction toward the facing row of teeth and a generally planar surface extending in a transverse direction relative to the flat shoulder; a first support means for supporting said strain relief member in close proximity with the opening in the top of said body, said first supporting means including a support wall connected to the second and fourth sides at a location interiorly of and in close proximity with the first and second rows of teeth; a second support means for supporting said strain relief member in close proximity with said removably connected portion provided in the first side of said body, said second support means including a support wall connected to the second and fourth sides at a location interiorly of and in close proximity with the third and fourth rows of teeth; a second removably connected portion provided in the third side of said body, said second removably connected portion being of a size sufficient to allow the conductor passage into the interior of said body; a fifth row of teeth provided on said body extending from the second side in close proximity with a junction of the second and third sides; and a sixth row of teeth provided on said body extending from the fourth side in a facing relationship with the fifth row of teeth across said second removably connected portion and disposed in close proximity with a junction of the third and fourth sides, each tooth in the fifth and sixth rows of teeth having a generally flat shoulder extending in a direction toward the facing row of teeth and a generally planar surface extending in a transverse direction relative to the flat shoulder.

5. A device as set forth in claim 4, further comprising: a third support means for supporting said strain relief member in close proximity with said second removably connected portion provided in the third side of said body, said third support means including a support wall connected to the second and fourth sides at a location interiorly of and in close proximity to said fifth and sixth rows of teeth.

6. A device as set forth in claim 4, further comprising: a first and second shoulder provided on said body extending away from the interior of said body outwardly of the first and second sides, respectively; a passageway extending through said first and second shoulders in a direction running generally from the top to bottom of said body, the passageway having a portion with a circular cross-section facing toward the bottom of said body and a constriction provided at the end of the circular cross-section portion nearer the top of said body to provide an abuttment for threads on a screw used in attaching said body to a computer.

7. A device to prevent connector pins attached to individual wires in a conductor from becoming removed from a computer connector, comprising: a body defining a chamber and including a top, a bottom and first, second, third and fourth sides joining the top and bottom, the top defining an opening of sufficient size to allow the conductor passage into the chamber, the bottom being open to receive the computer connector, a first row of teeth extending from the second side in close proximity with a junction of the second side and top, and a second row of teeth extending from the fourth side in a facing relationship with the first row of teeth across the opening and disposed in close proximity with a junction of the fourth side and top, a removably connected portion provided in the first side of said body, the portion being of a size sufficient to allow the conductor passage into the interior of said body, a third row of teeth provided on said body extending from the second side in close proximity with a junction of the first and second sides, and a fourth row of teeth provided on said body extending from the fourth side in a facing relationship with the third row of teeth across said removably connected portion and disposed in close proximity with a junction of the first and fourth sides, each tooth in the rows of teeth having a generally flat shoulder extending in a direction toward the facing row of teeth and a generally planar surface extending in a transverse direction relative to the flat shoulder; strain relief means for securing the conductor to said body; supporting means provided on said body for supporting said strain relief means in close proximity to the opening in the top, said supporting means including a support wall connected to the second and fourth sides at a location interiorly of and in close proximity with the first and second rows of teeth; and connecting means provided on said body for securing the computer connector to the bottom of said body, said connecting means including a first connecting member provided at the bottom of said body and extending along one of the sides, a second connecting member provided at the bottom of said body and extending along a side opposed to the side from which the first connecting member extends, the first and second connecting members having a lip portion and a connecting portion, the lip portion of one connecting member extending toward the lip portion on the opposed connecting member, the connecting portion having a length sufficient to receive a shoulder on the computer connector between the lip portion and bottom, the connector pins being prevented from becoming removed from the computer connector when moving the conductor after said strain relief means has secured the conductor to said body and said connecting means has secured the computer connector to said body; said supporting means including a support wall connected to the second and fourth sides at a location interiorly of and in close proximity with the first and second rows of teeth; a second support means for supporting said strain relief member in close proximity with said removably connected portion provided in the first side of said body, said second support means including a support wall connected to the second and fourth sides at a location interiorly of and in close proximity with the third and fourth rows of teeth; and a third support means for supporting said strain relief member in close proximity with a second removably connected portion provided in the third side of said body, said third support means including a support wall connected to the second and fourth sides at a location interiorly of and in close proximity to a fifth and sixth rows of teeth.

8. A device as set forth in claim 7, further comprising: said connecting means including the lip portion on the first and second connecting members having a beveled surface facing away from the interior of said body to facilitate movement of the computer connector between the first and second connecting members.

9. A device as set forth in claim 7, further comprising: a first and second shoulder provided on said body extending away from the interior of said body outwardly of the first and second sides, respectively; a passageway extending through said first and second shoulders in a direction running generally from the top to bottom of said body, the passageway having a portion with a circular cross-section facing toward the bottom of said body and a constriction provided at the end of the circular cross-section portion nearer the top of said body to provide an abuttment for threads on a screw used in attaching said body to a computer.

10. A device to prevent connector pins attached to individual wires in a conductor from becoming removed from a computer connector, comprising: a body adapted to define a chamber and including first and second body halves with the halves being mirror images of one another, each half having a substantially planar side wall, facing side walls joined to and extending along opposite sides of and transversely to the planar wall, a connecting wall interconnecting the facing side walls and joined to and extending along a side of and transversely to the planar wall, an opening being provided in the connecting wall, each said body half having a shoulder extending outwardly of the facing side wall away from the chamber in said body, a groove being provided in a face of the shoulder so as to provide a passageway through the shoulder when the body halves are connected together, the groove having a semicircular cross-section portion and a semi-oval cross-section portion, the oval cross-section portion having a major axis approximately the same size as the diameter of the semicircular portion so as to provide a constriction in the passageway; body half connecting means for connecting the first and second halves of said body to one another, such that when the first and second body halves are connected to one another the substantially planar side walls form second and fourth sides, the facing side walls form first and third sides, the connecting walls form a top with an opening allowing the conductor access into the chamber of said body and a bottom being open to receive the computer connector; computer connector connecting means provided on said body for securing the computer connector to the bottom of said body; and strain relief means for securing the conductor to said body, the connector pins being prevented from becoming removed from the computer connector when moving the conductor after said strain relief means has secured the conductor to said body and said computer connector connecting means has secured the computer connector to said body.

11. A device as set forth in claim 10, further comprising: said body half connecting means including a tubular extension provided on each body half and disposed to extend from the planar side wall interiorly of said body, a passageway generally aligned with a passage in the tubular extension of the other body half when the body halves are connected together, and screw means for each passageway for urging the body halves into engagement when screwed into the passage of the tubular extension.

12. A device as set forth in claim 10, further comprising: said body half connecting means including at least two screws, each screw having a shank with threads extending outwardly from the shank and a head with a lip circumscribing the shank and extending in a direction away from the head in the same direction as the shank.

13. A device as set forth in claim 10, further comprising: each body half including a set of teeth disposed to face the opening in the connecting wall and in close proximity with the junction of the connecting wall and the planar wall to form first and second rows of teeth, which face one another when the halves are connected together; and said strain relief means including a generally U-shaped member with a base and two arms connected to and extending away from the base, the arms being displaced away from one another by a distance sufficient to receive the conductor between a portion of the arms, a series of teeth being disposed along each arm so as to face in a direction away from the other arm and thereby allow the series of teeth on the arms to engage the rows of teeth disposed in said body when the halves are connected together.

14. A device as set forth in claim 13, further comprising: each body half including each tooth in the set of teeth having a generally flat shoulder disposed to extend in a direction toward the facing row of teeth and a generally planar surface disposed to extend in a transverse direction relative to the flat shoulder; and said strain relief means including each tooth in the series on the strain relief member having a tapering shoulder to deflect the arms toward one another when the strain relief member is moved along the rows of teeth in said body and a substantially flat shoulder to complimentarily engage the substantially flat shoulder on at least one tooth in the rows of teeth in said body to prevent movement of said strain relief member in a direction toward the substantially flat shoulder.

15. A device as set forth in claim 14, further comprising: each body half including a support wall for supporting said strain relief member within said body, the support wall being connected to the planar wall at a location interiorly of the row of teeth of said body.

16. A device as set forth in claim 14, further comprising: each body half including a first removably connected portion in one of the facing side walls to permit removal of the removably connected portion and a second removably connected portion in the other facing side wall, the removably connected portions being of a size sufficient to allow the conductor passage into the interior of said body when the body halves are connected to one another and the removably connected portion is removed.

17. A device as set forth in claim 16, further comprising: each body half including a second set of teeth disposed to face the first removably connected portion and a third set of teeth disposed to face the second removably connected portion, the second and third sets of teeth being disposed in close proximity with the junction of each of the facing side walls and the planar wall such that the second set forms third and fourth rows of teeth, which face one another when the body halves are connected together and such that the third set forms fifth and sixth rows of teeth, which face one another when the halves are connected together.

18. A device as set forth in claim 17, further comprising: each body half including a second support wall for supporting the strain relief member within said body near to the first removably connected portion, the second support wall being connected to the planar wall at a location interiorly of the third and fourth rows of teeth on said body, and a third support wall for supporting the strain relief member within said body near to the second removably connected portion, the third support wall being connected to the planar wall at a location interiorly of the fifth and sixth rows of teeth on said body.

* * * * *